US011350709B2

(12) United States Patent
Haramein

(10) Patent No.: US 11,350,709 B2
(45) Date of Patent: Jun. 7, 2022

(54) FRAMES FOR GEOMETRIC SOLIDS

(71) Applicant: TORUS TECH, INC., San Clemente, CA (US)

(72) Inventor: Nassim Haramein, San Clemente, CA (US)

(73) Assignee: TORUS TECH LLC, San Clemente, CA (US)

( * ) Notice: Subject to any disclaimer, the term of this patent is extended or adjusted under 35 U.S.C. 154(b) by 135 days.

(21) Appl. No.: 16/687,580

(22) Filed: Nov. 18, 2019

(65) Prior Publication Data

US 2020/0154837 A1 May 21, 2020

Related U.S. Application Data

(60) Provisional application No. 62/768,777, filed on Nov. 16, 2018.

(51) Int. Cl.
*G09B 23/26* (2006.01)
*A44C 17/02* (2006.01)

(52) U.S. Cl.
CPC ..... *A44C 17/02* (2013.01)

(58) Field of Classification Search
CPC ..... G09B 23/00; G09B 23/06; G09B 23/26; G09B 25/00; A63H 33/04; A63H 33/046; A63H 33/06; A63H 33/062; A63H 33/10; A44C 17/02
See application file for complete search history.

(56) References Cited

U.S. PATENT DOCUMENTS 4,698,023 A * 10/1987 Marino ..... G09B 1/36 434/259
4,701,131 A * 10/1987 Hildebrandt ..... A63F 9/12 434/211
5,154,656 A * 10/1992 Milstein ..... A63H 33/04 434/259
5,417,603 A * 5/1995 De Chazal ..... A63F 9/001 108/62
5,567,194 A * 10/1996 Stapleton ..... A63H 33/04 446/124
5,623,790 A * 4/1997 Lalvani ..... A63B 9/00 52/81.2
6,749,480 B1 * 6/2004 Hunts ..... A63H 33/046 446/85
8,911,276 B2 * 12/2014 Kim ..... A63H 33/046 446/92
9,022,829 B2 * 5/2015 Rosen ..... A63H 33/046 446/92

(Continued)

FOREIGN PATENT DOCUMENTS

FR 2618311 1/1989
WO 2006132458 12/2006

*Primary Examiner* — Kurt Fernstrom
(74) *Attorney, Agent, or Firm* — Fish IP Law, LLP

(57) ABSTRACT

Systems that are used to support a plurality of frames arranged in a specific configuration are contemplated. The system comprises outer frame panels that removably couple to the plurality of frames. It is contemplated that the outer frame panels collectively couple to the plurality of frames to thereby provide additional stability to maintain the plurality of frames in the specific configuration, such that the risk of the plurality of frames losing their specific configuration during transport is reduced.

20 Claims, 20 Drawing Sheets

(56) References Cited

U.S. PATENT DOCUMENTS

| | | | | |
|---|---|---|---|---|
| 9,199,182 | B2 | 12/2015 | Hunts | |
| 9,466,228 | B2 | 10/2016 | Haramein | |
| 9,642,428 | B2 | 5/2017 | Brown et al. | |
| 9,669,324 | B2 * | 6/2017 | Roth | A63H 5/00 |
| 10,080,977 | B2 * | 9/2018 | Rosen | A63H 33/046 |
| 10,258,896 | B2 * | 4/2019 | Ornstein | A63H 33/06 |
| 10,327,545 | B2 * | 6/2019 | McPhillips | F16M 13/022 |
| 10,328,355 | B2 | 6/2019 | Rosen et al. | |
| 10,497,283 | B2 * | 12/2019 | Fekl | G09B 23/26 |
| 2014/0179194 | A1 * | 6/2014 | Fein | A63H 33/046 446/92 |
| 2014/0298945 | A1 * | 10/2014 | Rus | B25J 9/08 74/490.01 |
| 2016/0332088 | A1 * | 11/2016 | Rakhsha | A63H 33/04 |
| 2018/0185765 | A1 * | 7/2018 | Zheng | A63H 33/046 |
| 2021/0101087 | A1 * | 4/2021 | Hu | A63H 18/04 |

* cited by examiner

FRAMES FOR GEOMETRIC SOLIDS

This application claims priority to U.S. Provisional Application Ser. No. 62/768,777, filed Nov. 16, 2018. All extrinsic materials identified herein are incorporated by reference in their entirety.

FIELD OF THE INVENTION

The field of the invention is frames, especially frames for geometric solids.

BACKGROUND

The background description includes information that may be useful in understanding the present invention. It is not an admission that any of the information provided herein is prior art or relevant to the presently claimed invention, or that any publication specifically or implicitly referenced is prior art.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Geometric solids (e.g., gems, crystals, etc.) are often mounted on a frame to form an ornamental or wearable item. For example, Fullin (French Patent App. Pub. No. FR 2618311) discloses a modular pendant for earrings having two elements with triangular profiles that couple to one another in a few different configurations via a housing and an apparent snap-fit connection between the housing and the two elements. Others have contemplated frames for geometric solids that can be used for other purposes. For example, Haramein (U.S. Pat. No. 9,466,228) discloses modular frames for geometric solids that can be used as an educational tool to demonstrate or investigate effects of a geometric solid in an environment.

Although frames for geometric solids have been disclosed, there is still a need in the art for improved frames for geometric solids.

SUMMARY OF THE INVENTION

The inventive subject matter provides apparatus, systems, and methods in which a plurality of frames coupled to one another in a configuration (e.g., frames in a specific matrix) can be securely held in the configuration. One contemplated system comprises a first outer frame panel and a second outer frame panel that each removably couple with the plurality of frames. Each of the first and second outer frame panels can be removably coupled to a first frame and a second frame of the plurality of frames to thereby hold the first frame and the second frame in the configuration. It should be appreciated that the first and second outer frame panels prevent or reduce the risk that the plurality of frames lose the configuration in which they are coupled while the plurality of frames are transported from a first location to a second location or in the case where the plurality of frames may be accidently shaken or bumped while they are at rest on a surface.

It is contemplated that the first outer frame panel is removably coupled to a first arm of the first frame and a first arm of the second frame. The second outer frame panel can be removably coupled to a second arm of the first frame and a second arm of the second frame. For example, the first outer frame panel can comprise a first arm that is configured to couple with the first arm of the first frame, and a second arm that is configured to couple with the first arm of the second frame. In such example, it is contemplated that the second outer frame panel can comprise a first arm that is configured to couple with the second arm of the first frame, and a second arm that is configured to couple with the second arm of the second frame. Collectively, the first and second outer frame panels can thereby hold the first frame and the second frame in the configuration. It is contemplated that more outer frame panels can be used to hold the plurality of frames in their coupled configuration.

The first outer frame panel can comprise a ring that is configured to couple with the first and second frames. A first arm of the first frame can be coupled to a first portion of the ring and a first arm of the second frame can be coupled to a second portion of the ring. It is contemplated that the second outer frame can also be a ring that is configured to couple with the first and second frames.

The first outer frame panel can comprise a first arm that extends from first corner of an opening, and a second arm that extends from a second corner of the opening. The first arm of the first outer frame panel is configured to couple with a first arm of the first frame, and the second arm of the first outer frame panel is configured to couple with a first arm of the second frame. It is contemplated that the second outer frame panel can also comprise a first arm that extends from first corner of an opening, and a second arm that extends from a second corner of the opening, and the first and second arms are configured to couple with the first and second frames.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The inventors have discovered outer frames panels that can be used to support frames coupled to one another in a specific configuration (e.g., frames in a specific matrix). The frames can be used to hold geometric solids (e.g., crystals, gems, etc.). The frames can be coupled to one another magnetically or mechanically to form the specific configuration. It should be appreciated that transporting such frames in a coupled configuration without additional reinforcements can be problematic when the forces involved with moving the frames overcome the forces retaining the frames in the specific configuration. Thus, contemplated outer frame panels provide the additional reinforcement and stability needed to transport the frames with a reduced risk that the configuration in which the frames are coupled is lost or distorted.

Figure 1:
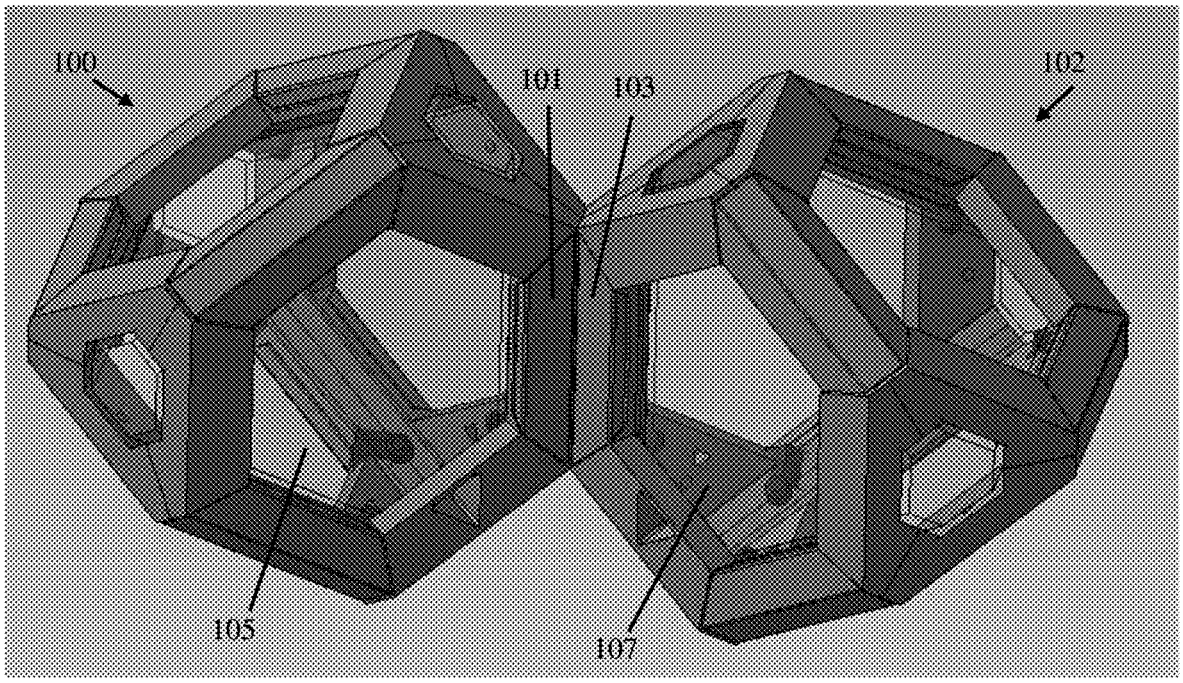
FIG. 1 is a perspective view of an embodiment of a first frame coupled to a second frame.
Figure 2:
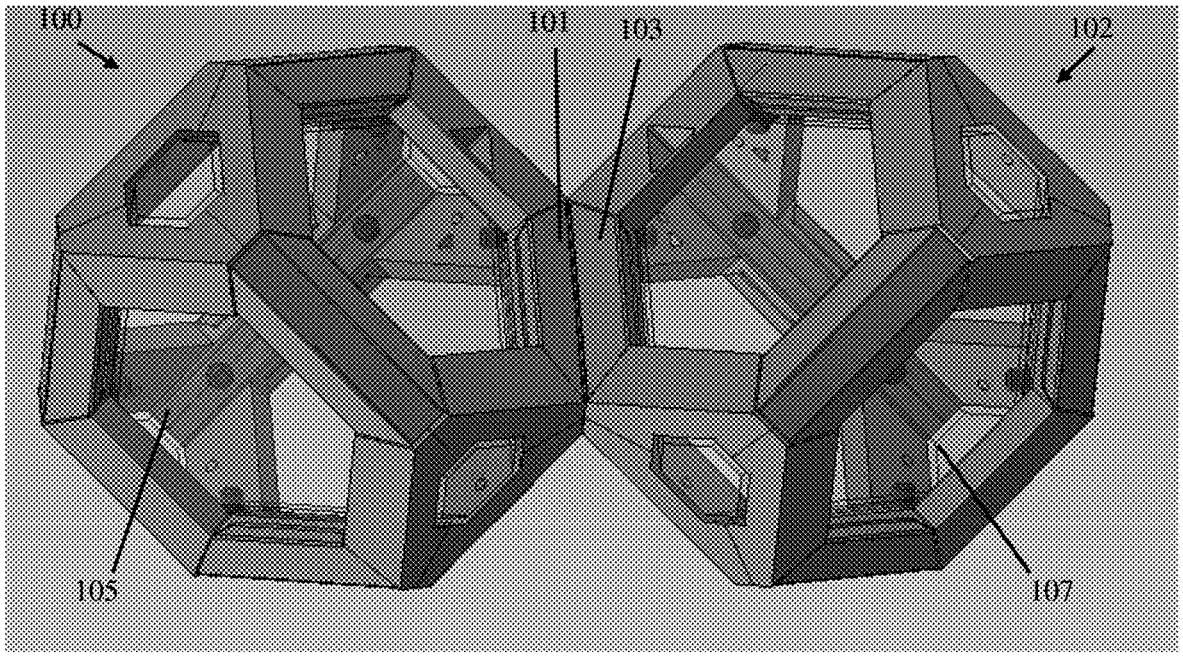
FIG. 2 is another perspective view of the first frame and second frame of FIG. 1.

FIGS. 1-2 show a first frame 100 and a second frame 102 coupled to one another. First frame 100 is configured to hold a first crystal 105, and second frame 102 is configured to hold a second crystal 107. It is contemplated that first crystal 105 and second crystal 107 are each a quartz crystal having a tetrahedral shape. For example, first crystal 105 and second crystal 107 can have a modified tetrahedral shape having four triangular faces joined at four truncated vertices and six chamfered edges. Suitable crystals are discussed in U.S. Pat. Nos. 9,745,669, 9,435,054, 9,834,862, and 10,094,046, which are hereby incorporated by reference. Materials for crystals comprise a synthetic form of naturally occurring crystal types, such as quartz, ruby, and diamond.

It is also contemplated that crystals held by first frame 100 and second frame 102 can be exposed to an electromagnetic field produced by a generator prior to being installed in the frame. Suitable generators are discussed in U.S. Pat. Nos. 8,073,094, 8,130,893, 8,933,595, 9,497,844, and 9,949,355, which are hereby incorporated by reference. It is contemplated that the electromagnetic field is sufficient to thereby cause oscillation of the piezoelectric (electromechanical) axis of the crystals. For example, it is contemplated that the crystals can be exposed to a circularly modulated electromagnetic field for a total of two hours.

First frame 100 and second frame 102 can be a modular frame in which frame panels are coupled to form a frame. For example, first frame 100 and/or second frame 102 can include a first frame panel, a second frame panel, a third frame panel, and a fourth frame panel. The first frame panel is coupled to the third frame panel via a first clip, the first frame panel is coupled with the fourth frame panel via a second clip, the first frame panel is coupled to the second frame panel via a third clip, the second frame panel is coupled with the fourth frame panel via a fourth clip, the third frame panel is coupled with the second frame panel via a fifth clip, and the third frame panel is coupled to the fourth frame panel via a sixth clip. In some other embodiments, it should be appreciated that contemplated frames could include any suitable number of frame panels (e.g., at least 5, at least 6, at least 7, at least 8, between 5-10, between 4-8) and any suitable number of clips (e.g., at least 5, at least 6, at least 7, at least 8, between 5-10, between 4-8).

The clips can form arms of a frame, and the clips can be removed to uncouple the frame panels. For example, a first clip of first frame 100 can form a first arm 101, and a first clip of second frame 102 can form a first arm 103. It is contemplated that a magnet is disposed underneath each of the clips within a slot formed by two adjacent frame panels. For example, first arm 101 of first frame 100 can be removably coupled to first arm 103 of second frame 102 via magnets disposed within first arm 101 and first arm 103 as shown in FIGS. 1-2. Suitable frames are discussed in U.S. application Ser. No. 15/723,052 and U.S. Pat. No. 9,466,228, which are hereby incorporated by reference. It is contemplated that the frames can be a single, unitary design as opposed to a modular design.

Figure 3:
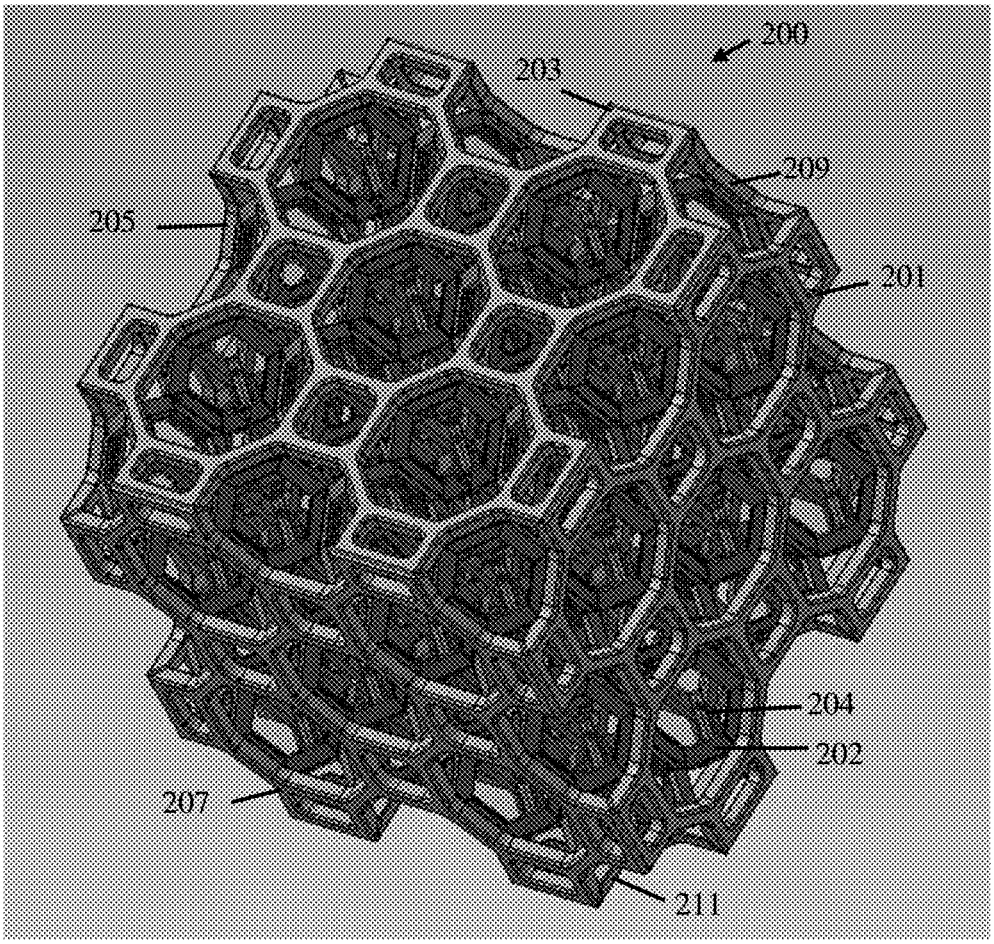
FIG. 3 is a perspective view of an embodiment of a system for holding a plurality of frames.
Figure 4:
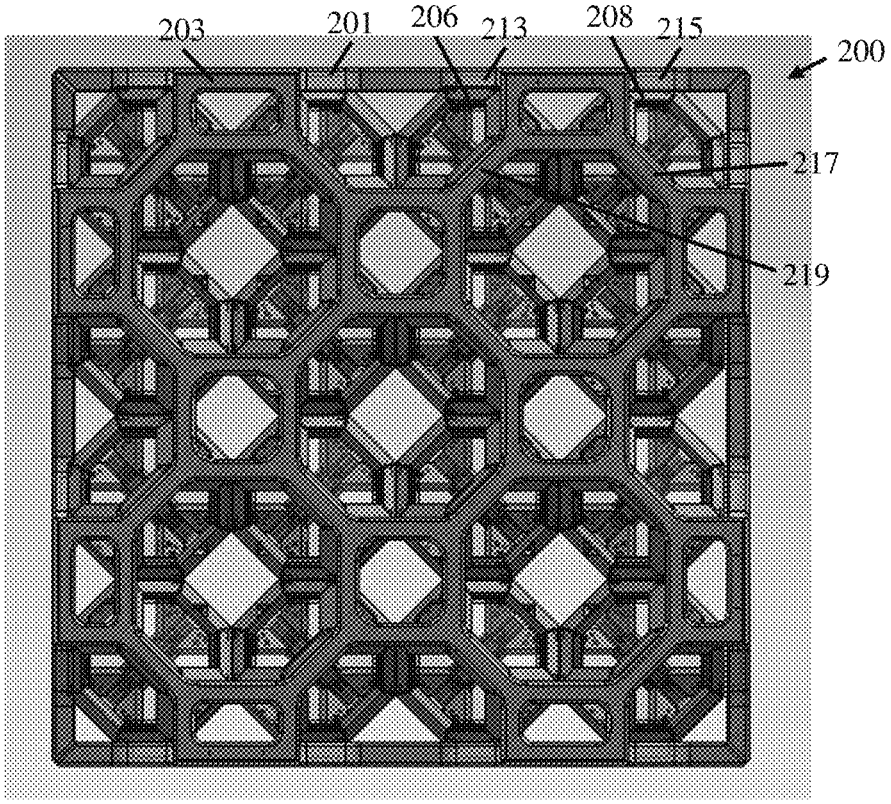
FIG. 4 is top view of the system of FIG. 3.
Figure 5:
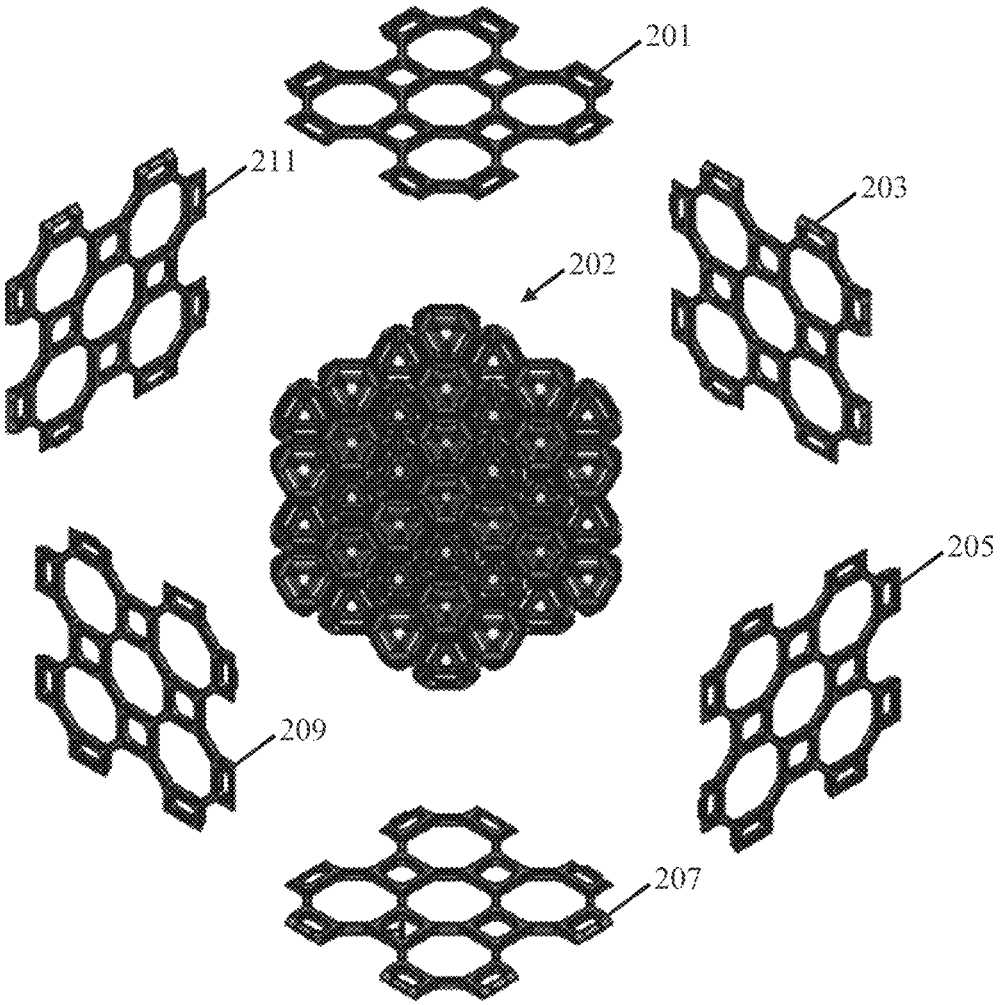
FIG. 5 is a partially exploded view of the system of FIG. 3.

FIGS. 3-5 show a system 200 for holding a plurality of frames 202 coupled to one another in a configuration. It is contemplated that plurality of frames 202 can comprise frames identical to first frame 100 and second frame 102, and one or more frames can hold a crystal 204. System 200 comprises a first outer frame panel 201 and a second outer frame panel 203 that removably couple with plurality of frames 202. It is contemplated that system 200 can further comprise one or more of a third outer frame panel 205, a fourth outer frame panel 207, a fifth outer frame panel 209, and a sixth outer frame panel 211 that each removably couple with plurality of frames 202 to thereby maintain their coupled configuration. It is contemplated that each of the outer frame panels can be coupled to four other outer frame panels to support plurality of frames 202.

As shown in FIGS. 3-4, plurality of frames 202 comprises 64 frames arranged in a configuration and supported by system 200. It is contemplated that the configuration of 64 frames each holds a crystal in isotropic vector equilibrium. Thus, system 200 can be used to transport plurality of frames 202 with a reduced risk that one or more frames of plurality of frames 202 will uncouple, such that their coupled configuration is lost or distorted.

It is contemplated that one or more of first outer frame panel 201, second outer frame panel 203, third outer frame panel 205, fourth outer frame panel 207, fifth outer frame panel 209, and sixth outer frame panel 211 removably couples to an arm of a frame of plurality of frames 202 to thereby hold plurality of frames 202 in the configuration. For example, first outer frame panel 201 can comprise (i) a first arm 213 that is configured to couple with a first arm 206 of a first frame, and (ii) a second arm 215 that is configured to couple with a first arm 208 of a second frame as shown in FIG. 4. Additionally, or alternatively, second outer frame panel 203 can comprise (i) a first arm 217 that is configured to couple with a second arm (behind first arm 217 when viewed in FIG. 4) of a first frame, and (ii) a second arm 219 that is configured to couple with a second arm (behind second arm 219 when viewed in FIG. 4) of a second frame as shown in FIG. 4.

Although plurality of frames 202 comprises 64 frames in FIGS. 3-5, it is contemplated that system 200 can be used to support more or less frames disposed in a configuration. For example, system 200 can be used to support between 2-25 frames, 25-50 frames, 50-100 frames, and more than 100 frames. It should be appreciated that the number of outer frame panels in system 200 will be adjusted appropriately to support a given number of frames. Additionally, outer frame panels of system 200 can be a metal, a ceramic, or a rigid or semi-rigid polymer. For example, outer frame panels of system 200 can be a titanium alloy (e.g., Ti-6Al-4V) or a stainless steel alloy (e.g., stainless steel 316L).

FIGS. 6 and 7A-7D show various views of first outer frame panel 201. First outer frame panel 201 comprises a slot 221 disposed on an arm 223. It is contemplated that slot 221 is sized and dimensioned to receive a magnet. In such embodiments, the magnet of first outer frame panel 201 can interact with a magnet of a frame of plurality of frames 202 to thereby magnetically couple first outer frame panel 201 with plurality of frames 202. For example, FIG. 4 shows first arm 213 of first outer frame panel 201 in contact with first arm 206 of a first frame, such that a magnet of first arm 213 of first outer frame panel 201 is interacting with a magnet in first arm 206 of the first frame to thereby couple the first frame with first outer frame panel 201.

Figure 6:
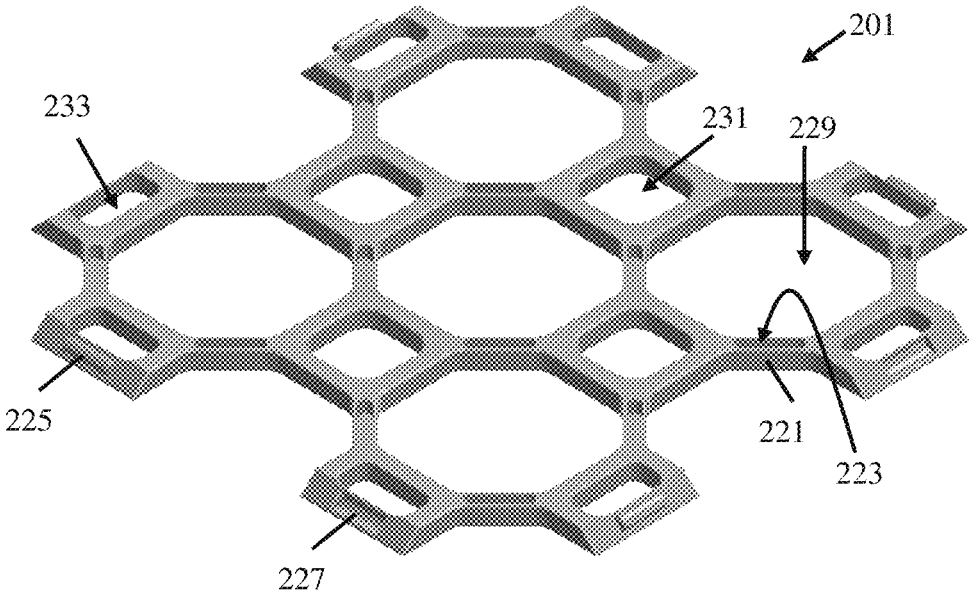
FIG. 6 is a perspective view of an outer frame panel of the system of FIG. 3.

As shown in FIG. 6, slots can be disposed throughout first outer frame panel 201. It is contemplated that one or more of second outer frame panel 203, third outer frame panel 205, fourth outer frame panel 207, fifth outer frame panel 209, and sixth outer frame panel 211 can comprise magnets that interact with magnets of the frames of plurality of frames 202 to thereby secure the coupled configuration of plurality of frames 202. Additionally, or alternatively, the outer frame panels of system 200 can mechanically couple with the frames of plurality of frames 202 (e.g., coupling between a projection and a cavity or openings, threaded connections, an adhesive, etc.).

FIG. 6 further shows that an outer edge of first outer frame panel 201 comprises a projection 225 and a cavity 227. It is contemplated that all four sides of first outer frame panel 201 can comprise an outer edge having a projection and a cavity as shown in FIG. 6, or that less sides have an outer edge having a projection and a cavity. Cavity 227 is sized and dimensioned to receive a projection of another outer frame panel, and projection 225 is sized and dimensioned to be received by a cavity of another outer frame panel to thereby couple first outer frame panel 201 to another outer frame panel. Although a projection and a cavity are shown to couple two outer frame panels, it is contemplated that the outer frame panels can be coupled using other means (e.g., adhesives, magnets, threaded couplings, etc.).

Figure 7A:
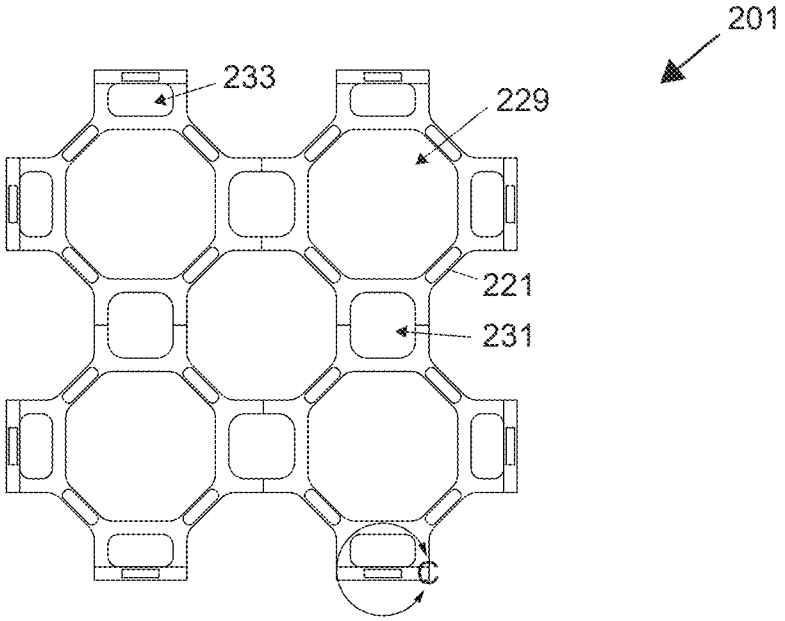
FIG. 7A is a top view of the outer frame panel of FIG. 6.
Figure 7B:
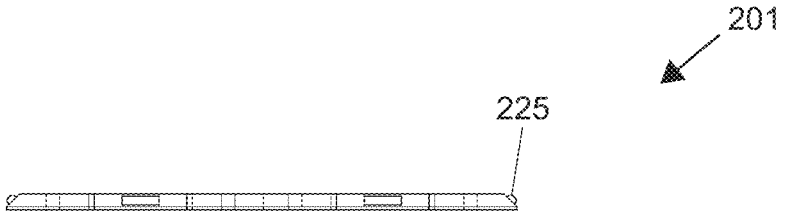
FIG. 7B is a side view of the outer frame panel of FIG. 6.
Figure 7C:
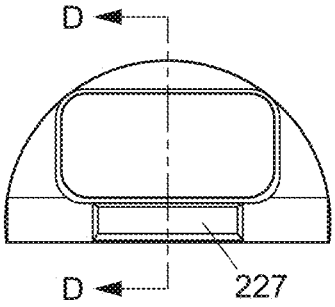
FIG. 7C is a magnified view of the encircled area "C" of FIG. 7A of the outer frame panel.
Figure 7D:
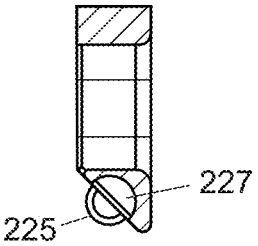
FIG. 7D is a cross-sectional view of the outer frame panel along line "D" of FIG. 7C.

First outer frame panel 201 also comprises various openings. For example, first outer frame panel can comprise a first set of openings 229, a second set of openings 231, and a third set of openings 333. First set of openings 229 each have a first area and second set of openings 231 each have a second area, wherein the first area is larger than the second area. It is contemplated that first set of openings 229 each have an octagon shape, and second set of openings 231 each have a square shape. As shown in FIGS. 6 and 7A, first outer frame panel 201 has an alternating pattern of openings of first set of openings 229 and openings of second set of openings 231. It is contemplated that openings of third set of openings 231 are disposed on an outer perimeter of the alternating pattern of openings as shown in FIGS. 6 and 7A.

Figure 8:
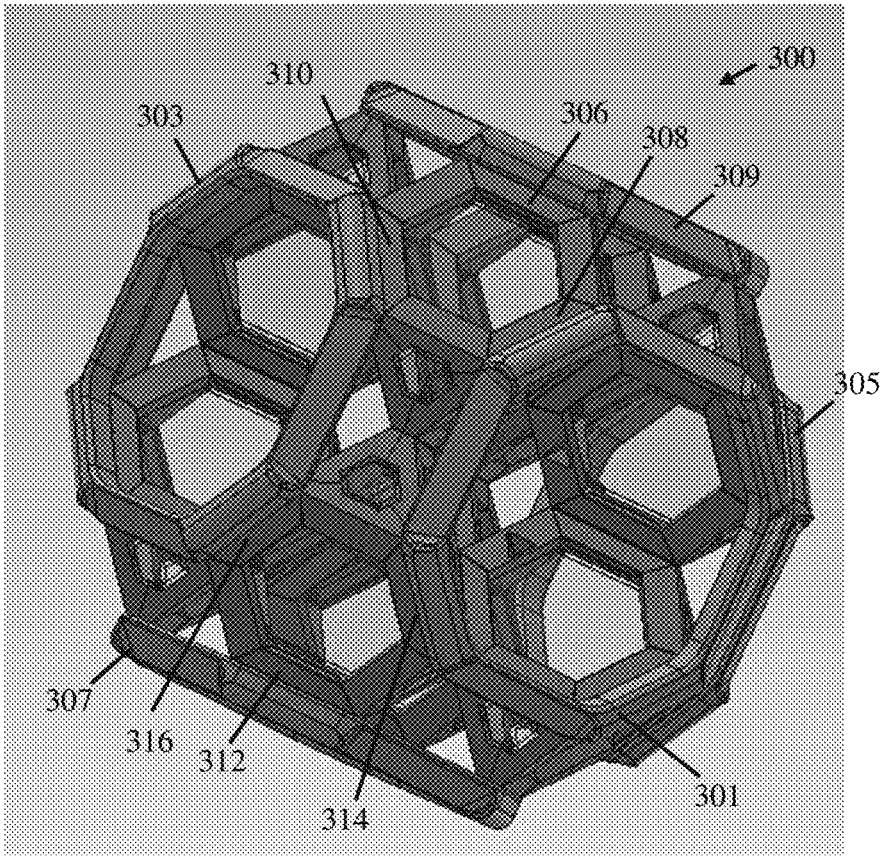
FIG. 8 is a perspective view of an embodiment of a system for holding a plurality of frames.
Figure 9:
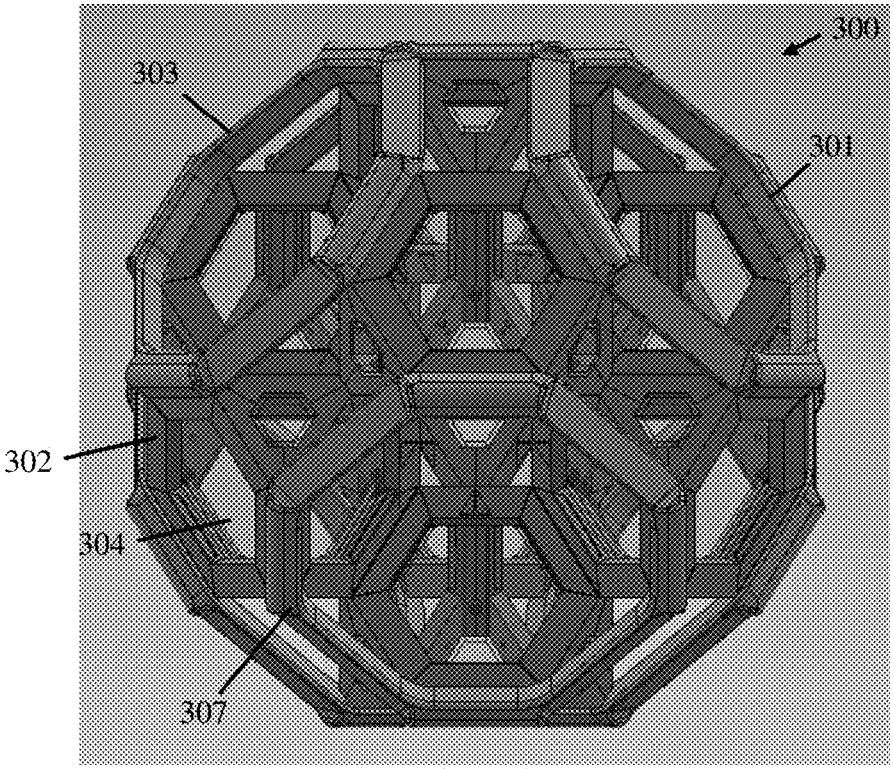
FIG. 9 is another perspective view of the system of FIG. 8.
Figure 10:
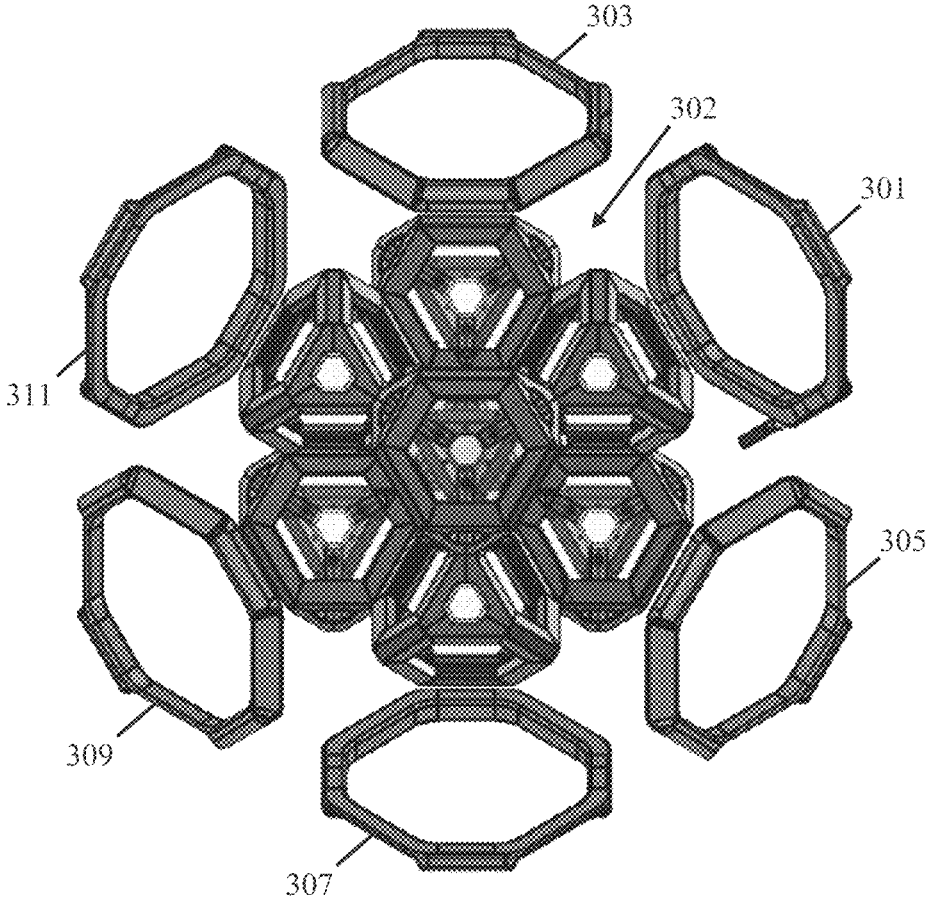
FIG. 10 is a partially exploded view of the system of FIG. 8.

FIGS. 8-10 show an embodiment of a system 300 for holding a plurality of frames 302 coupled to one another in a configuration. It is contemplated that plurality of frames 302 can comprise frames identical to first frame 100 and second frame 102, and one or more frames can hold a crystal 304. System 300 can comprise one or more of a first outer frame panel 301, a second outer frame panel 303, a third outer frame panel 305, a fourth outer frame panel 307, a fifth outer frame panel 309, and a sixth outer frame panel 311. It is contemplated that each of the outer frame panels of system 300 can couple to four frames of plurality of frames 302 to thereby support plurality of frames 302 in the coupled configuration.

As shown in FIGS. 8-10, plurality of frames 302 comprises 8 frames each holding a crystal and coupled to one another in a configuration. It is contemplated that suitable configurations are matrices of a stella octangular, star shape, or a cuboctahedron in a spherical shape. Thus, system 300 can be used to transport plurality of frames 302 with a reduced risk that one or more frames of plurality of frames 302 will uncouple, such that their coupled configuration is lost or distorted.

It is contemplated that one or more of first outer frame panel 301, second outer frame panel 303, third outer frame panel 305, fourth outer frame panel 307, fifth outer frame panel 309, and sixth outer frame panel 311 removably couples to an arm of a frame of plurality of frames 302 to thereby hold plurality of frames 302 in the configuration. For example, a first frame 306 of plurality of frames 302 can comprise a first arm 308 that is coupled to a first portion of first outer frame panel 301, and a second frame 312 of plurality of frames 302 can comprise a first arm 314 that is coupled to a second portion of first outer frame panel 301 as shown in FIG. 8. Additionally, or alternatively, first frame 306 of plurality of frames 302 can comprise a second arm 310 that is coupled to a first portion of second outer frame panel 303, and second frame 312 of plurality of frames 302 can comprise a second arm 316 that is coupled to a second portion of second outer frame panel 303 as shown in FIG. 8.

Although plurality of frames 302 comprises 8 frames in FIGS. 8-10, it is contemplated that system 300 can be used to support more or less frames disposed in an configuration.

For example, system 300 can be used to support between 2-25 frames, 25-50 frames, 50-100 frames, and more than 100 frames. It should be appreciated that the number of outer frame panels in system 300 can be adjusted appropriately to support a given number of frames. Additionally, outer frame panels of system 300 can be a metal, a ceramic, or a rigid or semi-rigid polymer. For example, outer frame panels of system 300 can be a titanium alloy (e.g., Ti-6Al-4V) or a stainless steel alloy (e.g., stainless steel 316L).

Figure 11:
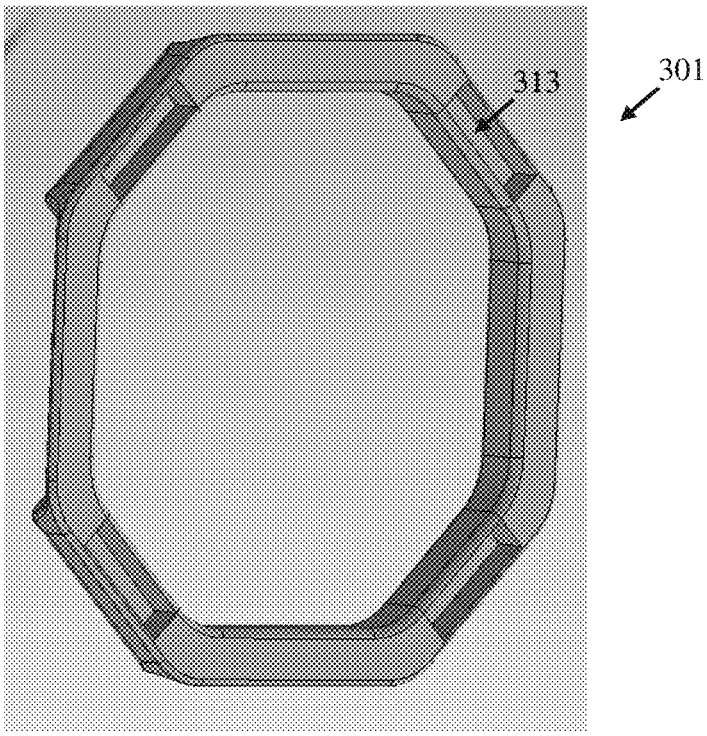
FIG. 11 is a perspective view of an outer frame panel of the system of FIG. 8.
Figure 12A:
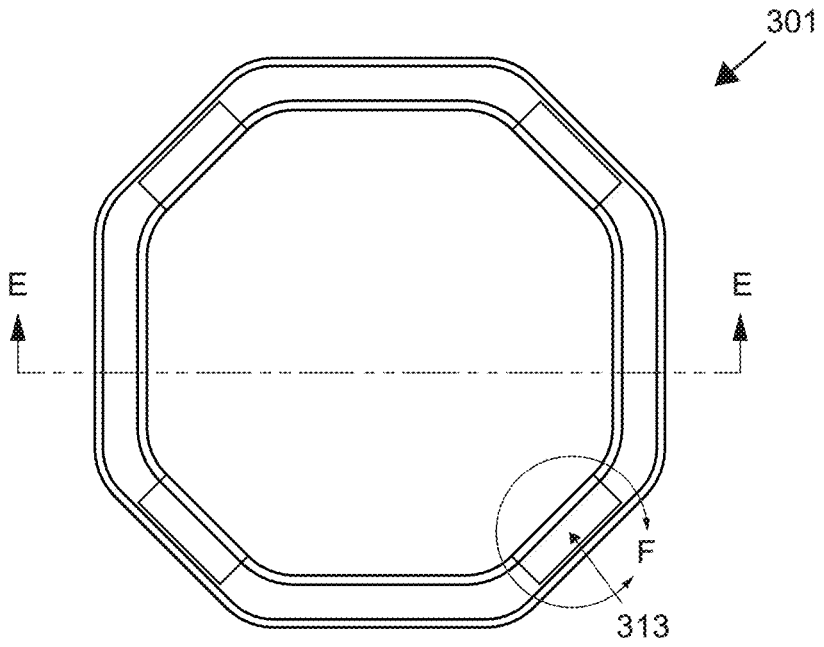
FIG. 12A is a top view of the outer frame panel of FIG. 11.
Figure 12B:
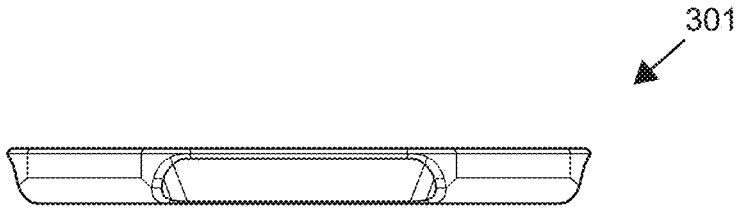
FIG. 12B is a side view of the outer frame panel of FIG. 11.
Figure 12C:
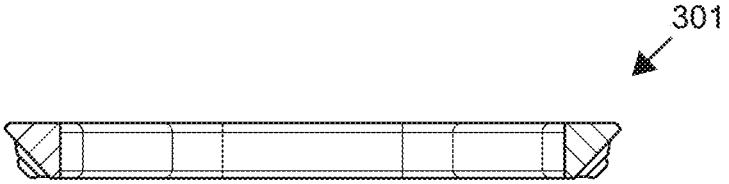
FIG. 12C is a cross-sectional view of the outer frame panel along line "E" of FIG. 12A.
Figure 12D:
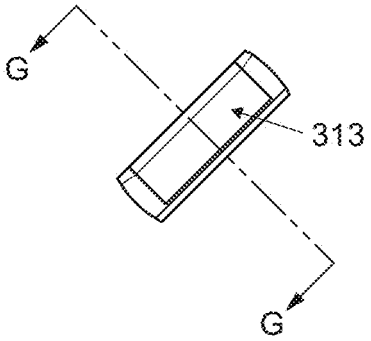
FIG. 12D is a magnified view of the encircled area "F" of FIG. 12A of the outer frame panel.
Figure 12E:
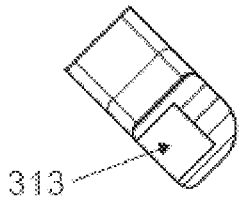
FIG. 12E is a cross-sectional view of the outer frame panel along line "G" of FIG. 12D.

FIGS. 11 and 12A-12E show first outer frame panel 301. First outer frame panel 301 is a ring shape and comprises a slot 313. As shown in FIGS. 11 and 12A, various slots are disposed on first outer frame panel 301. It is contemplated that slot 313 is sized and dimensioned to receive a magnet. In such embodiments, the magnet of first outer frame panel 301 can interact with a magnet of a frame of plurality of frames 302 to thereby magnetically couple first outer frame panel 301 with the frame. For example, FIG. 8 shows first arm 308 of first frame 306 and first arm 314 of second frame 312 in contact with different portions of first outer frame panel 301, such that magnets of first outer frame panel 301 are interacting with magnets of first arm 308 of first frame 306 and first arm 314 of second frame 312 to thereby couple first outer frame panel 301 with plurality of frames 302. It is contemplated one or more of second outer frame panel 303, third outer frame panel 305, fourth outer frame panel 307, fifth outer frame panel 309, and sixth outer frame panel 311 can comprise magnets that interact with magnets of the frames of plurality of frames 302 to secure the coupled configuration of plurality of frames 302. Additionally, or alternatively, the outer frame panels of system 300 can mechanically couple with the frames of plurality of frames 302 (e.g., coupling between a projection and a cavity or openings, threaded connections, an adhesive, etc.).

Figure 13:
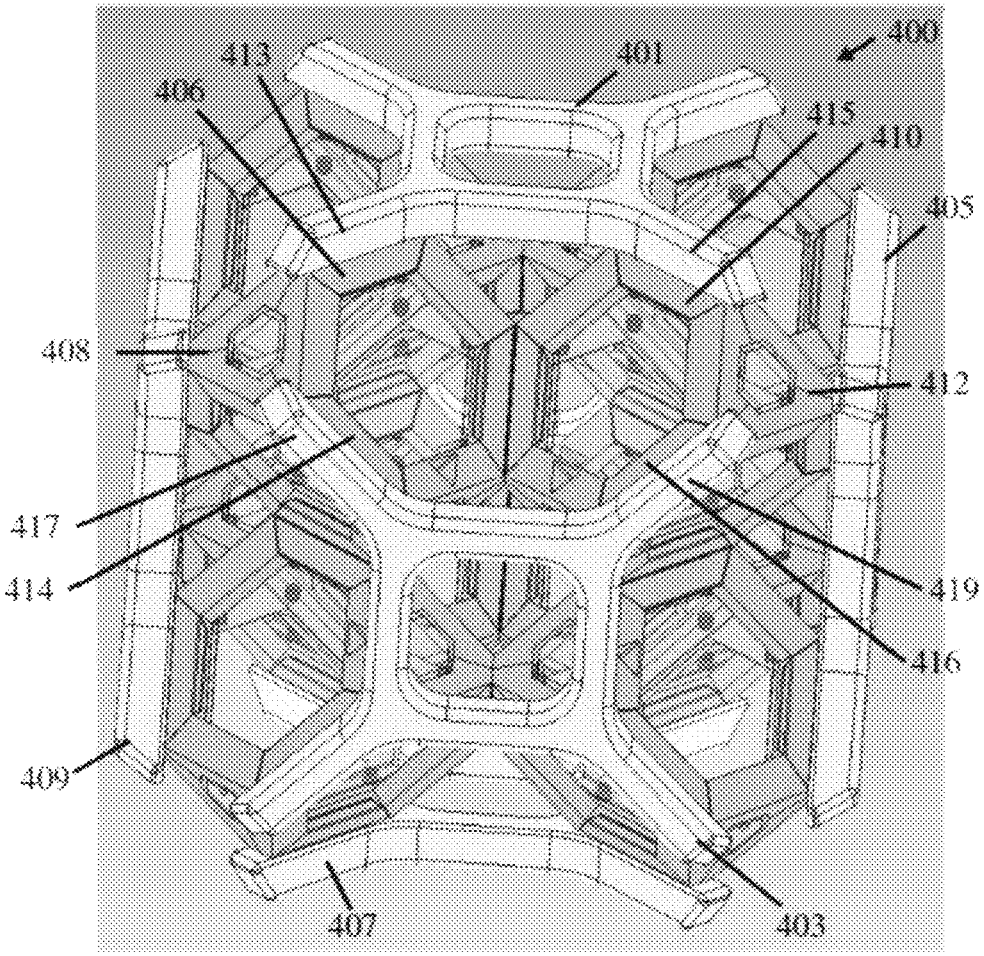
FIG. 13 is a perspective view of an embodiment of a system for holding a plurality of frames.
Figure 14:
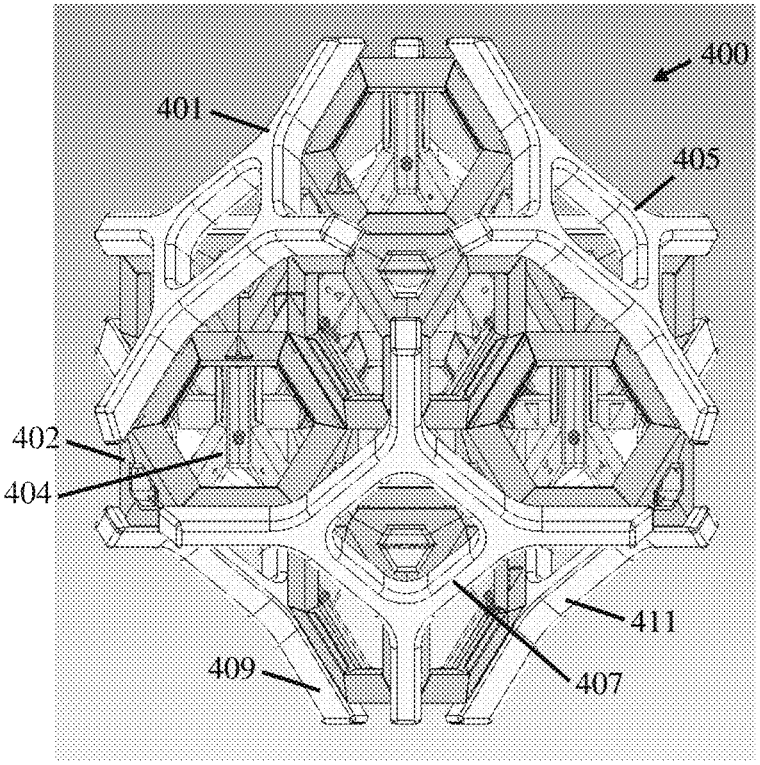
FIG. 14 is another perspective view of the system of FIG. 13.
Figure 15:
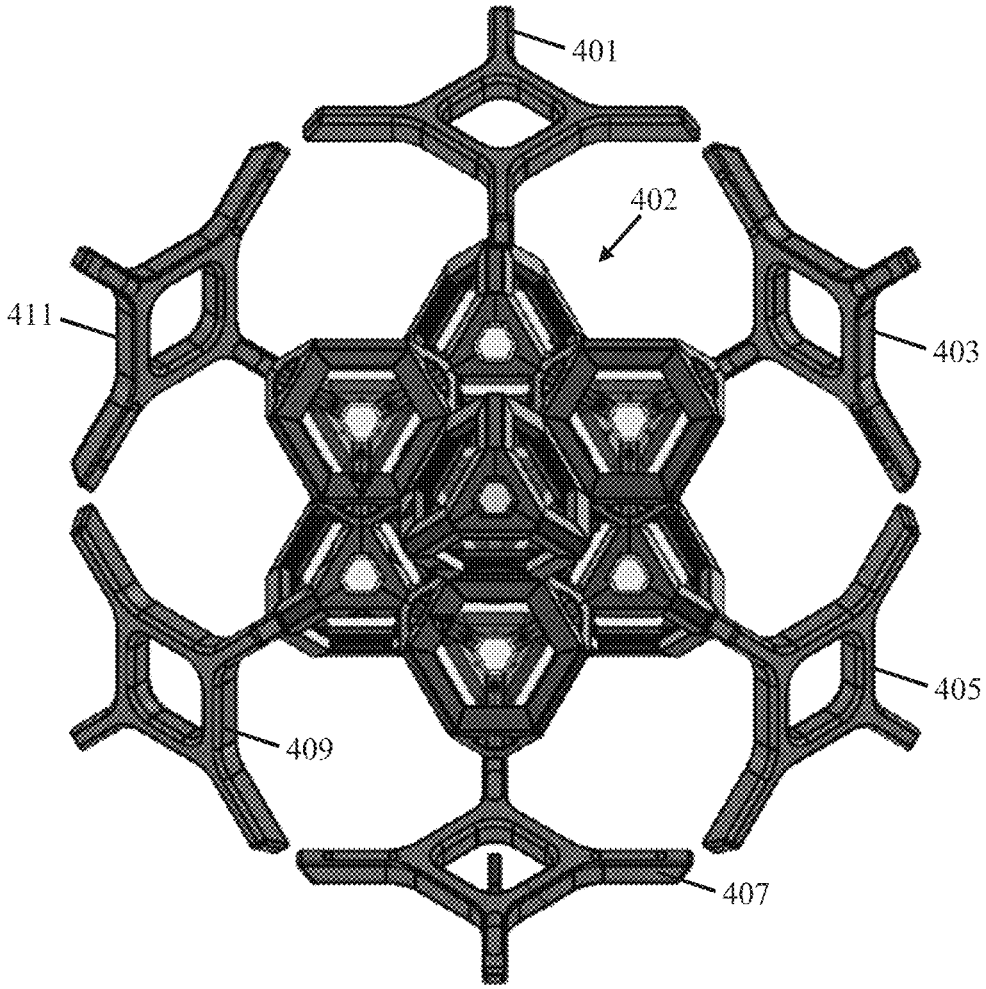
FIG. 15 is a partially exploded view of the system of FIG. 13.

FIG. 13-15 show a system 400 for holding a plurality of frames 402 coupled to one another in a configuration. It is contemplated that plurality of frames 402 can comprise frames identical to first frame 100 and second frame 102, and one or more frames can hold a crystal 404. System 400 comprises one or more of a first outer frame panel 401, a second outer frame panel 403, a third outer frame panel 405, a fourth outer frame panel 407, a fifth outer frame panel 409, and a sixth outer frame panel 411. It is contemplated that each of the outer frame panels can be coupled to four frames of plurality of frames 402 to thereby support plurality of frames 402 in the coupled configuration.

As shown in FIGS. 13-15, plurality of frames 402 comprises 8 frames each holding a crystal and coupled to one another in a configuration. It is contemplated that suitable configurations are matrices of a stella octangular, star shape, or a cuboctahedron in a spherical shape. Thus, system 400 can be used to transport plurality of frames 402 with a reduced risk that one or more frames of plurality of frames 402 will uncouple, such that their coupled configuration is lost or distorted.

It is contemplated that one or more of first outer frame panel 401, second outer frame panel 403, third outer frame panel 405, fourth outer frame panel 407, fifth outer frame panel 409, and sixth outer frame panel 411 are removably coupled to an arm of a frame of plurality of frames 402 to thereby hold plurality of frames 402 in the configuration. For example, first outer frame panel 401 can comprise (i) a first arm 413 that is configured to couple with a first arm 406 of a first frame 408, and (ii) a second arm 415 that is configured to couple with a first arm 410 of a second frame 412 as shown in FIG. 13. Additionally, or alternatively, second outer frame panel 403 can comprise (i) a first arm 417 that is configured to couple with a second arm 414 of a first frame 408, and (ii) a second arm 419 that is configured to couple with a second arm 416 of a second frame 412 as shown in FIG. 13.

Although plurality of frames 402 comprises 8 frames in FIGS. 13-15, it is contemplated that system 400 can be used to support more or less frames disposed in a configuration. For example, system 400 can be used to support between 2-25 frames, 25-50 frames, 50-100 frames, and more than 100 frames. It should be appreciated that the number of outer frame panels in system 400 can be adjusted appropriately to support a given number of frames. Additionally, outer frame panels of system 400 can be a metal, a ceramic, or a rigid or semi-rigid polymer. For example, the outer frame panels of system 400 can be a titanium alloy (e.g., Ti-6Al-4V) or a stainless steel alloy (e.g., stainless steel 316L).

FIGS. 16 and 17A-17E show various views of first outer frame panel 401. First outer frame panel 401 comprises a slot 421 disposed on an arm 423, and an opening 425. It is contemplated that slot 421 is sized and dimensioned to receive a magnet. In such embodiments, the magnet of first outer frame panel 401 can interact with a magnet of a frame of plurality of frames 402 to thereby magnetically couple first outer frame panel 401 with the frame. For example, FIG. 13 shows first arm 413 of first outer frame panel 401 in contact with first arm 406 of first frame 418, such that a magnet in first arm 413 of first outer frame panel 401 is interacting with a magnet in first arm 406 of first frame 408 thereby couple first frame 408 and first outer frame panel 401. It is contemplated that one or more of second outer frame panel 403, third outer frame panel 405, fourth outer frame panel 407, fifth outer frame panel 409, and sixth outer frame panel 411 can comprise magnets that interact with magnets of the frames of plurality of frames 402 to thereby secure the coupled configuration of plurality of frames 402. Additionally, or alternatively, the outer frame panels of system 400 can mechanically couple with the frames of plurality of frames (e.g., coupling between a projection and a cavity or openings, threaded connections, an adhesive, etc.).

Figure 16:
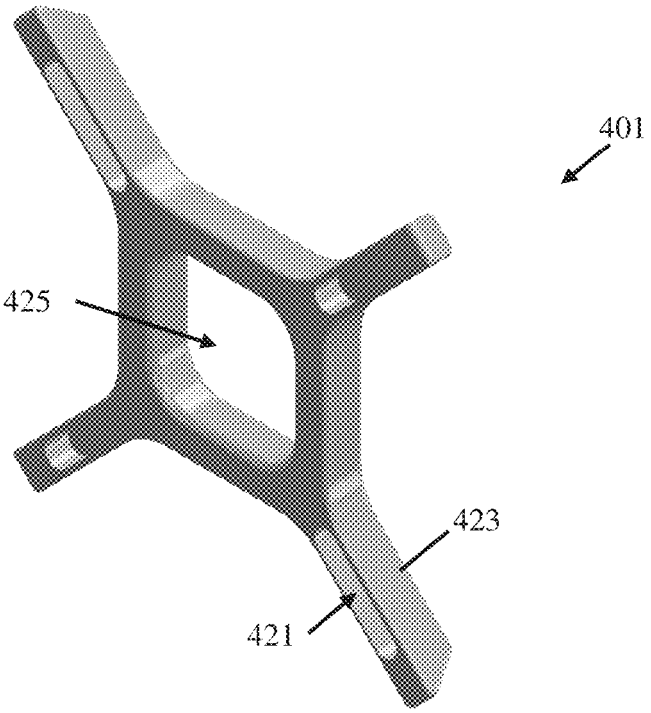
FIG. 16 is a perspective view of an outer frame panel of the system of FIG. 13.
Figure 17A:
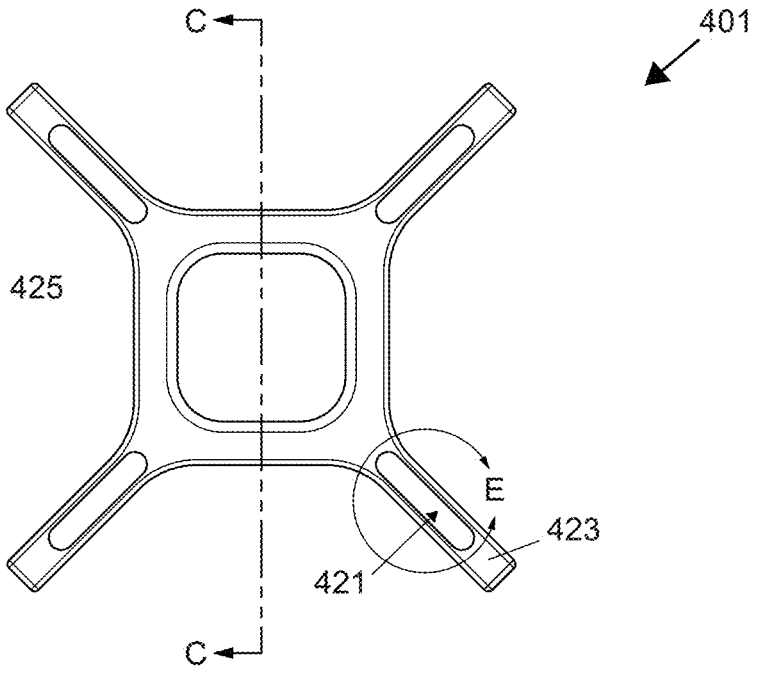
FIG. 17A is a top view of the outer frame panel of FIG. 16.
Figure 17B:
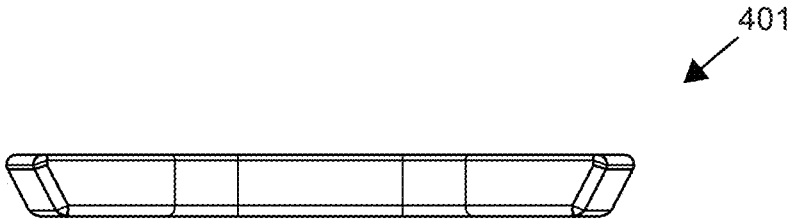
FIG. 17B is a side view of the outer frame panel of FIG. 16.
Figure 17C:
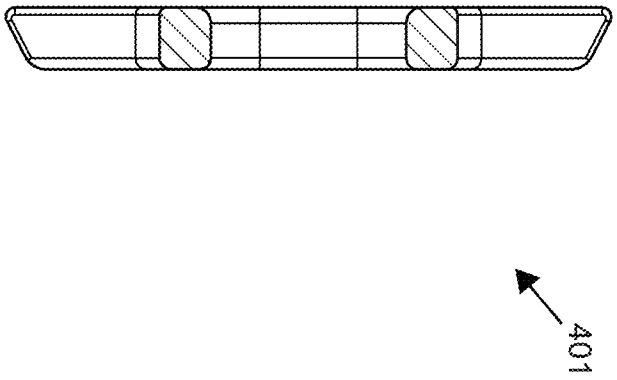
FIG. 17C is a cross-sectional view of the outer frame panel along line "C" of FIG. 17A.
Figure 17D:
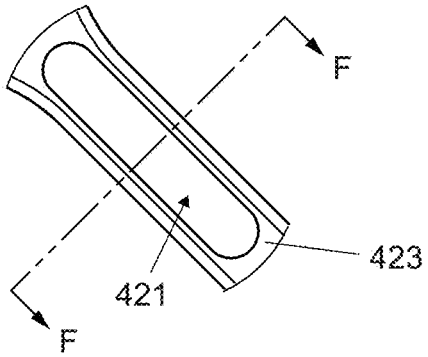
FIG. 17D is a magnified view of the encircled area "E" of FIG. 17A of the outer frame panel.
Figure 17E:
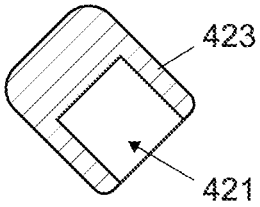
FIG. 17E is a cross-sectional view of the outer frame panel along line "F" of FIG. 17D.

As shown in FIGS. 16 and 17A, first outer frame panel 401 comprises arm 423 extends from a corner of opening 425. First outer frame panel 401 can comprise four arms that extend from corners of opening 425. It is contemplated that two of the arms collinear, and that a slot is disposed on each of the arms.

Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A system for holding a plurality of frames that are coupled to one another in a configuration, the plurality of frames comprising a first frame and a second frame each having a first arm and a second arm, wherein the first frame is coupled to the second frame, the system comprising:

a first outer frame panel;

a second outer frame panel; and wherein (i) the first outer frame panel is removably coupled to the first arm of the first frame and the first arm of the second frame, and (ii) the second outer frame panel is removably coupled to the second arm of the first frame and the second arm of the second frame to thereby hold the first frame and the second frame in the configuration.

2. The system of claim 1, wherein the first outer frame panel comprises a first arm and a second arm, and the first arm of the first outer frame panel is configured to couple with the first arm of the first frame, and the second arm of the first outer frame panel is configured to couple with the first arm of the second frame.

3. The system of claim 2, further comprising a first magnet disposed in the first arm of the first outer frame panel, and a second magnet disposed in the second arm of the first outer frame panel.

4. The system of claim 3, wherein the first arm of the first outer frame panel comprises a slot sized and dimensioned to receive the first magnet.

5. The system of claim 2, wherein the second outer frame panel comprises a first arm and a second arm, and the first arm of the second outer frame panel is configured to couple with the second arm of the first frame, and the second arm of the second outer frame panel is configured to couple with the second arm of the second frame.

6. The system of claim 5, further comprising a first magnet disposed in the first arm of the first outer frame panel, a second magnet disposed in the second arm of the first outer frame panel, a third magnet disposed in the first arm of the second outer frame panel, and a fourth magnet disposed in the second arm of the second outer frame panel.

7. The system of claim 5, wherein the first outer frame panel comprises a projection, and the second outer frame panel comprises cavity sized and dimensioned to receive the projection to thereby couple the first outer frame panel and the second outer frame panel.

8. The system of claim 2, wherein the first outer frame panel comprises a first set of openings that each have a first area and a second set of openings that each have a second area, and further wherein the first area is larger than the second area.

9. The system of claim 8, wherein the first set of openings each have an octagonal shape, and the second set of openings each have a square shape.

10. The system of claim 8, wherein the first outer frame panel comprises an alternating pattern of openings of the first set of openings and openings of the second set of openings.

11. The system of claim 10, wherein the first outer frame panel comprises a third set of openings that are disposed on an outer perimeter of the alternating pattern openings.

12. The system of claim 11, wherein the first set of openings each have a first shape, the second set of openings each have a second shape, and the third set of openings each have a third shape, and further wherein the first shape, the second shape, and the third shape are different.

13. The system of claim 8, wherein an opening of the first set of openings comprises a boundary, and wherein the first arm and the second arm of the first outer frame panel form a portion of the boundary.

14. The system of claim 13, wherein the first arm of the first outer frame panel extends from a corner of an opening of the second set of openings.

15. The system of claim 1, wherein the first outer frame panel is a first ring, and wherein the first arm of the first frame is coupled to a first portion of the first ring and the first arm of the second frame is coupled to a second portion of the first ring.

16. The system of claim 15, further comprising a first magnet disposed in the first portion of the first ring and a second magnet disposed in the second portion of the first ring.

17. The system of claim 15, wherein the second outer frame panel is a second ring, and wherein the second arm of the first frame is coupled to a first portion of the second ring and the second arm of the second frame is coupled to a second portion of the second ring.

18. The system of claim 1, wherein the first outer frame panel comprises an opening, and further wherein the first outer frame panel comprises a first arm that extends from a first corner of the opening and a second arm that extends from a second corner of the opening.

19. The system of claim 18, wherein the first arm of the first outer frame panel is configured to couple with the first arm of the first frame, and the second arm of the first outer frame panel is configured to couple with the first arm of the second frame.

20. The system of claim 19, further comprising a first magnet disposed in the first arm of the first outer frame panel and a second magnet disposed in the second arm of the first outer frame panel.

* * * * *